United States Patent [19]

Reisinger, Jr.

[11] 4,272,306

[45] Jun. 9, 1981

[54] CARBURIZING TUB APPARATUS AND METHOD

[75] Inventor: George E. Reisinger, Jr., York, Pa.

[73] Assignee: Caterpillar Tractor Co., Peoria, Ill.

[21] Appl. No.: 88,722

[22] Filed: Sep. 27, 1979

[51] Int. Cl.[3] ..... C21D 1/48

[52] U.S. Cl. ..... 148/16.5; 148/16; 148/20.3; 266/251; 266/274; 266/279; 432/261

[58] Field of Search ..... 266/251, 252, 253, 274, 266/279; 148/16, 16.5, 16.6, 16.7, 20.3; 432/253, 258, 261

[56] References Cited

U.S. PATENT DOCUMENTS

| | | | |
|---|---|---|---|
| 1,915,949 | 6/1933 | Peterson | 266/253 |
| 2,161,162 | 6/1939 | Harsch | 148/16.5 |
| 2,789,808 | 4/1957 | Blackman | 266/252 |
| 3,642,263 | 2/1972 | Pine | 263/47 |
| 4,165,868 | 8/1979 | Southern | 266/252 |

FOREIGN PATENT DOCUMENTS

| | | | |
|---|---|---|---|
| 2205579 | 7/1972 | Fed. Rep. of Germany | 432/253 |

*Primary Examiner*—L. Dewayne Rutledge
*Assistant Examiner*—John P. Sheehan
*Attorney, Agent, or Firm*—Phillips, Moore, Weissenberger, Lempio & Majestic

[57] ABSTRACT

PCT No. PCT/US79/00792 Sec. 371 Date Sept. 27, 1979 Sec. 102(e) Date Sept. 27, 1979 PCT Filed Sept. 27, 1979

Parts (12) to be treated are placed in grid bottomed tubs (**14*a*, 14*b*, 14*c*) and the tubs (14*a*, 14*b*, 14*c*) are stacked one upon the other. A flow of treating gas is directed exteriorly about and internally through the tubs (14*a*, 14*b*, 14*c*) from an entrance end (26) to an exit end (28). If the parts (12) in the entrance tub or tubs (14*a*, 14*b*) are sufficiently but not overly treated, it has been found that the parts (12) near the exit end (28) of tub or tubs (14*b*, 14*c*) are not sufficiently treated. If the parts (12) near the exit end (28) tub or tubs (14*b*, 14*c*) are sufficiently treated, then the parts (12) in the entrance end (26) of tub or tubs (14*a*, 14*b*) are over treated. This problem is solved by providing a member (31) having at least one lateral aperture (32, 32′ or 32″) in a stacked column (16) of the tubs (14*a*, 14*b*, 14*c*) intermediate the ends (26 and 28) thereof and provides a flow of gas through the aperture (32, 32′ or 32″) from the exterior of the column (16). This provides a proper gas concentration in the tub or tubs (14*b*, 14*c*) near the exit end (28) as well as in the tub or tubs (14*a*, 14*b*) at the entrance end (26**).

16 Claims, 5 Drawing Figures

CARBURIZING TUB APPARATUS AND METHOD

DESCRIPTION

1. Technical Field

The invention relates to an improvement in an apparatus and method for carburizing the surfaces of metal parts with a carburizing gas to alter the surface properties of the parts prior to case hardening. Such parts may be, for example, hollow bushings for track pins, piston pins or the like.

2. Background Art

It is well known to carburize parts such as bushings for track pins and the axial bores of piston pins, to enhance subsequent hardening of the exposed surfaces thereof. One method of accomplishing this is to place the parts which are to be carburized in a plurality of tubs which have grids spanning the bottoms thereof, to stack the tubs one atop the other, and to flow a carburizing gas downwardly through the stacked tubs. Such tubs generally have solid or flow impervious sidewalls. It has been found that when the amount of carburizing gas used is sufficient to provide for a proper (not too much or too little) degree of subsequent hardening to the surfaces of the parts in the upper tubs, then the parts in the lower tub or tubs are not sufficiently carburized to provide for the desired surface hardening. On the other hand, if one uses enough carburizing gas to adequately carburize and subsequently harden the surfaces of the parts in the bottom tubs, then the parts in the upper tubs become over carburized (surface embrittled). In either event, sufficient uniformity of carburization of all of the parts is not attained.

One attempt to solve this problem has been to use spacer tubes in the upper tubs. Some of the carburizing gas can then pass downwardly through the spacer tubes without reaction with the parts held in the upper tubs. This, however, takes up a relatively great deal of space whereby the entire volumes of the tubs are not being effectively used to carburize parts. The result is a significantly reduced output of parts.

Another attempt to solve the above problem has been to use wire buckets or the like (fully open lattice sidewalls) to hold the parts to be carburized. In such a situation, however, it is difficult to direct gas flow uniformly through the baskets so that each and every one of the parts in the baskets is assured of getting a relatively uniform degree of carburization and, hence, a relatively uniform surface coating. That is, the flow through the ventilated tubs or wire buckets tend to follow the flow path of least resistance and some of the parts (in relatively stagnant locations) are not carburized as much as other of the parts (in higher flow locations).

Hence, the prior art has not provided an apparatus which combines the dual desirable attributes of a forced flow uniformly contacting all of the exposed parts to prevent stagnation and substantially an equal concentration of carburizing gas contacting each of the parts being carburized.

DISCLOSURE OF INVENTION

The present invention is directed to overcoming one or more of the problems as set forth above.

In one aspect of the present invention, an improvement is provided in a method of treating the surfaces of a plurality of parts by contacting them with a treating gas wherein the parts are placed on an open framework with a pair of open ended tubular tubs having generally flow impervious sidewalls, forming a column by placing a tubular spacer member between the tubs, directing the gas in a first flow path longitudinally through the column, and controllably directing the gas inwardly into the column through a plurality of apertures in the tubular spacer member.

In another aspect of the present invention an improvement is made in an apparatus for contacting parts with a gas, which apparatus includes a plurality of open ended generally tubular tubs having generally flow impervious sidewalls and having means for being stacked together end-to-end to form a column, each tub having at least one end thereof spanned by an open framework which serves to maintain some of the parts in the respective tub and means for impelling the gas to flow sequentially through the tubs from an entry to an exit end of a stacked column thereof. The improvement comprises a member having at least one lateral aperture, the member being positioned in a stacked column of the tubs intermediate an entry end and an exit end of the column and means for causing a flow of gas to enter the aperture externally of the column.

The technical problem solved by the present invention is that of providing a forced flow of gas over a plurality of parts which are being treated with the gas and maintaining the concentration of the treating gas substantially constant when it contacts each of the parts. The problem is solved by introducing a supplemental flow of gas into a vertical column wherein a plurality of the parts are positioned and through which a primary flow of the gas is flowing in one direction. This assures that lower portions of the column are exposed to a concentration of the gas substantially equal to that in the higher portions of the column. Because of the tubular nature of the overall column, forced flow is assured and each of the parts is relatively equally swept with gas. The present invention has the very significant practical advantage of being useful with existing equipment. That is, present equipment does not require modification, but rather only addition of a relatively inexpensive member.

BEST MODE FOR CARRYING OUT THE INVENTION

Figure 1:
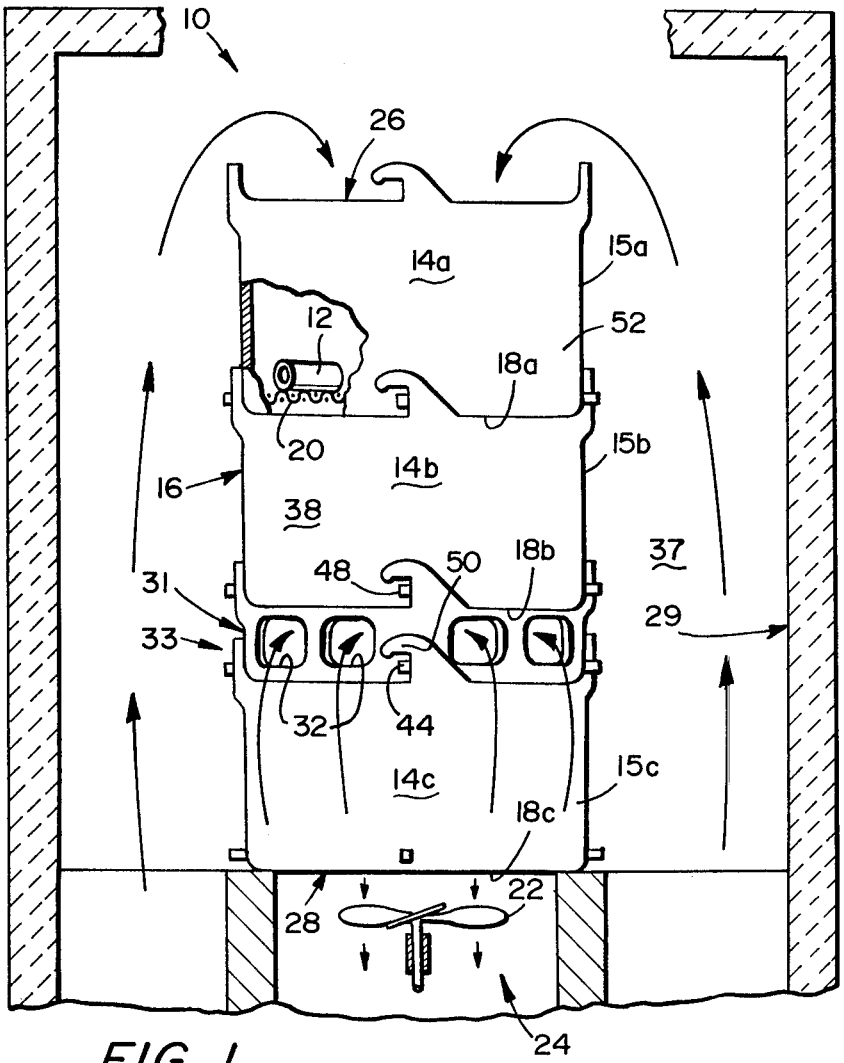
FIG. 1 illustrates an embodiment of the present invention wherein flow of a treating gas is upward externally of a column of tubs and a spacer member and downward through the column.

Adverting to FIG. 1 there is illustrated therein an apparatus 10 for contacting parts 12 with a gas. The apparatus 10 includes a plurality of open ended generally tubular tubs 14*a*, 14*b*, and 14*c* having flow impervious sidewalls 15*a*, 15*b*, 15*c*, the tubs 14*a*, 14*b*, 14*c* being substantially stacked together end-to-end to form a tubular column 16. The term "tubular" is used herein in its usual sense and includes rectangular and other cross-sectional shapes as well as the cylindrical shapes illustrated in the drawings. Each tub 14*a*, 14*b* and 14*c* has at least one end, 18*a*, 18*b*, 18*c* spanned by an open framework 20 which serves to maintain some of the parts 12 in each of the respective tubs 14*a*, 14*b* and 14*c*. A fan 22 serves as means 24 for impelling the gas to flow, as shown by the downwardly directed arrows in FIG. 1, sequentially through the tubs 14*a*, 14*b* and 14*c* from an entry end 26 of the column 16 to an exit end 28 thereof. The fan 22, in effect, provides a downward suction interiorly of the column 16. The exit end 28 of the column 16 would normally sit upon an open framework structure within an oven 29 and the gas would normally be conventionally regenerated externally of the oven to have sufficient carburizing gas content to properly carburize the various parts 12.

Figure 3:
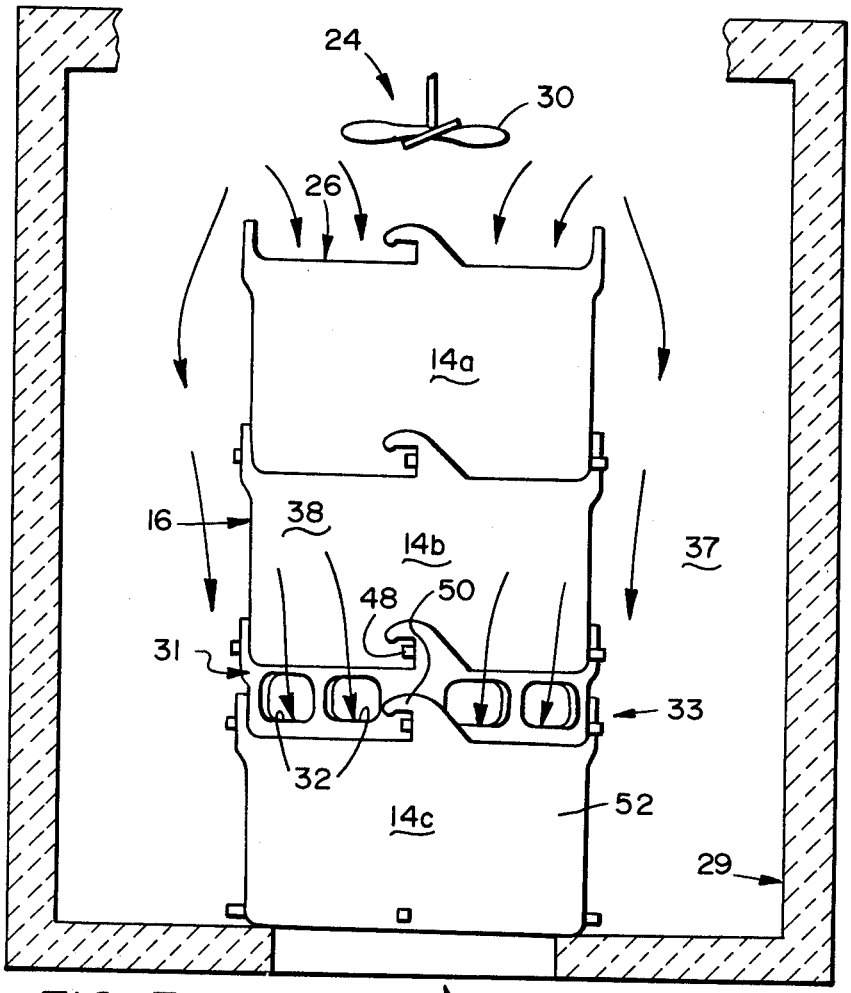
FIG. 3 illustrates an embodiment of the present invention wherein the flow of treating gas external of the column of tubs and a spacer member is generally downwardly.
Figure 4:
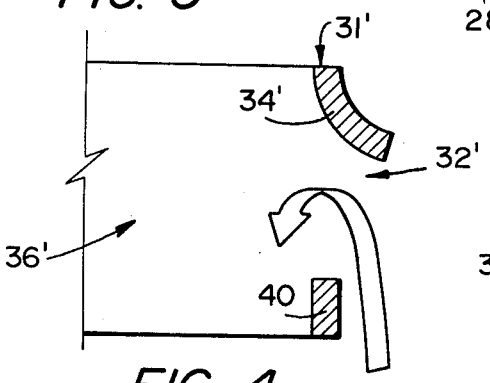
FIG. 4 illustrates a detail in a first alternate embodiment of the add-on ring of FIGS. 1–3 wherein baffle means are provided for directing air flow as shown in FIG. 1 to enter the column.
Figure 5:
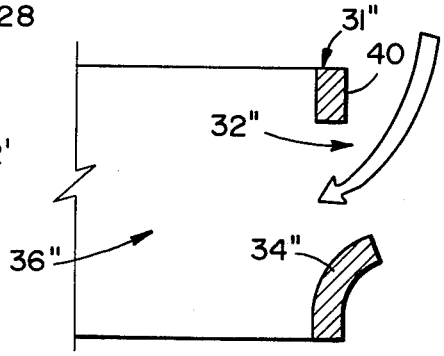
FIG. 5 illustrates a detail in a second alternate embodiment of the add-on ring of FIGS. 1–3 wherein baffle means are provided for directing supplemental gas flow as shown in FIG. 3 to enter the column.

Referring briefly to FIG. 3, it will be noted that the same tubs 14*a*, 14*b* and 14*c* are shown therein as are shown in FIG. 1 and that the prime difference between the embodiments of FIGS. 1 and 3 is that the gas flow in FIG. 3 is forced generally downwardly by an overhead fan 30 and through the column 16. The structure of the columns 16 of FIGS. 1 and 3 are then substantially the same, with the exception of certain alternate embodiments of these structures which will be discussed in following and as are shown in FIGS. 4 and 5.

In accordance with the present invention a tubular spacer member 31 is located between a pair of the tubs 14*a*, 14*b* and 14*c*. There is at least one lateral aperture 32 in the spacer member 31 in column 16 of the tubs 14*a*, 14*b* and 14*c* and the aperture 32 is located only in a selected longitudinally restricted area 33 intermediate the entry end 26 and the exit end 28 of the column 16. Generally, the aperture, or more usually apertures 32 are equally spaced about the column 16.

It should be noted that the parts 12 treated in the column 16 will normally be metallic parts which are having their surfaces carburized by contact with a carburizing gas, that is a reducing gas such as methane, natural gas, liquified petroleum gas, or the like. In such a situation the column 16 is usually situated vertically and the parts 12 normally sit upon the respective frameworks 20 of each of the tubs 14*a*, 14*b* and 14*c*. The oven 29 serves as means 37 for supplying gas at the apertures 32. It should further be noted that the impelling means 24 also serves as means for causing a flow of gas to enter the aperture or apertures 32 from an exterior 38 of the column 16.

Figure 2:
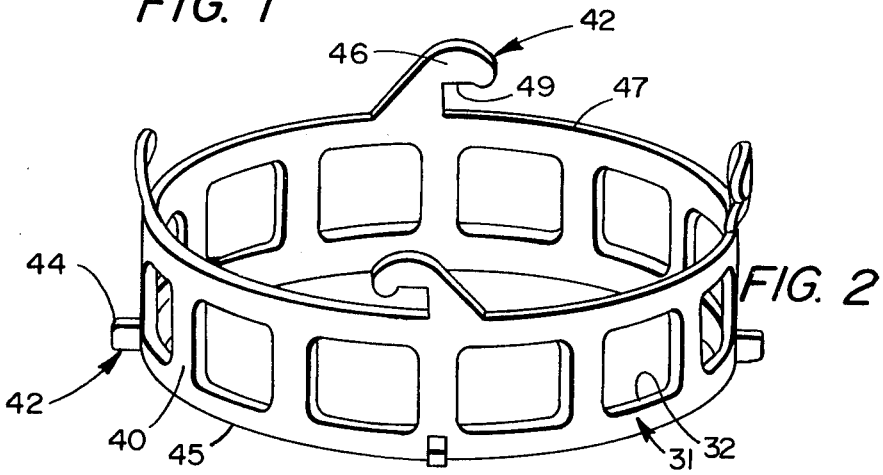
FIG. 2 illustrates an add-on ring which is useful with prior art tubs to produce an apparatus in accordance with an embodiment of the present invention.

The spacer member or ring 31 is seen best in FIG. 2. It will be noted that the spacer ring 31 is formed of interlocking coupling and an endless wall 40 and has means 42 for stacking it in the column 16 intermediate adjacent of the tubs 14*a*, 14*b* and 14*c*. In particular, the spacer ring 31 has a plurality of radially outwardly extending projections or nubs 44 at a first or bottom end 45 thereof and a plurality of hooks 46 at a second or top end 47 thereof, with each of the hooks 46 defining respective recesses 49 catching over a respective (see FIG. 1) nub 48 on one of the tubs, for example the tub 14*b*, and each of the nubs 44 being caught by a respective hook 50 on a lower one of the tubs, for example the tub 14*c*. The hooks 46 extend longitudinally and divergingly outwardly from the top end 47 of the spacer ring 31,31′ or 31″. It is particularly advantageous to practice the invention through utilizing a spacer ring 31 as just described, since, presently existing tubs 14*a*, 14*b*, 14*c* can continue to be used and it is only necessary to produce such spacer rings 31 and insert them in presently existing apparatus.

Through utilizing an apparatus 10 in accordance with the present invention, a relatively steady flow of gas through the column 16 is assured whereby all of the parts 12 are equally swept with gas, and, due to the introduction of a supplemental flow of gas via the apertures 32, the concentration of essential gas, for example, carburizing gas, in each of the tubs 14*a*, 14*b* and 14*c* is substantially the same so that parts 12 in each of the tubs 14*a*, 14*b* and 14*c* are substantially equally surface carburized for subsequent hardening.

ALTERNATE EMBODIMENTS OF FIGS. 4 and 5

Adverting to FIG. 4 it will be seen that in a first alternate embodiment of the spacer member 31, the apertures 32′ may be baffled as at 34′ with the baffle 34′ serving as means 36′ for directing the gas flow shown in FIG. 1 to enter the apertures 32′.

Adverting to FIG. 5 there is seen therein a second alternate embodiment of the spacer member 31″, wherein baffle 34″ serves as means 36″ for directing the gas flow to enter the apertures 32″ when such gas flow as is shown in FIG. 3.

METHOD

In accordance with the present invention, a method of treating the surfaces of a plurality of parts 12 is thus provided by contacting them with a treating gas. The parts 12 are distributed in a plurality of open ended tubular tubs 14*a*, 14*b* and 14*c* having generally impervious sidewalls 15*a*, 15*b* and 15*c*, with the tubs each having at least the one end 18*a*, 18*b* or 18*c* thereof spanned by the open framework 20 which holds some of the parts 12 therein but which does not appreciably restrict flow of the treating gas therethrough. The tubs 14*a*, 14*b* and 14*c* are stacked end-to-end to form a column 16 having the entry end 26 into which the treating gas is flowed and the exit end 28 from which the treating gas exits. A supplemental flow of gas is introduced into the column through at least one aperture 32 located only in a selected area 33 in a spacer member 31 which forms a part of a lateral wall 52 of the column 16 intermediate the entry end 26 and the exit end 28 of the column 16. Generally, the parts will be metal and the treating will be carburizing of the surfaces of the parts, whereby both the treating gas and the supplemental gas will be carburizing gases. Means 36′ or 36″ will usually be provided which will serve to direct the supplemental gas flow entering the apertures 32′ or 32″ into the column 16.

INDUSTRIAL APPLICABILITY

The invention is particularly useful for treating parts which are to have their external surfaces carburized. Such parts as track bushings need such carburizing to provide for subsequent heat treating operations to improve the wear properties of the treated article. Also, piston pins need such carburizing to prevent cracking of the interior axial bores thereof due to insufficient carburization prior to hardening.

Other aspects, objects and advantages of this invention can be obtained from a study of the drawings, the disclosure and the appended claims.

It is claimed:

1. An apparatus (10) for controllably contacting a plurality of parts (12) with a gas, comprising:

a pair of tubular tubs (**14*b*,14*c*) open at both ends, having flow impervious sidewalls (15*b*,15*c*) and an open framework (20) for holding the parts (12) within each respective tube (14*b*, 14*c*); and a tubular spacer member (31,31′ or 31″) having an aperture (32,32′ or 32″) extending laterally therethrough, the spacer member (31,31′ or 31″) being located longitudinally between the tubs (14*b*,14*c*) in abutting relation thereto to define, with said tubs (14*b*,14*c*), a stacked column (16) and a first flow path for the gas longitudinally through the column (16), and the aperture (32,32′ or 32″) defining a second flow path for ingress of the gas from exteriorly of said column (16**) to the first flow path.

2. The apparatus (10) of claim 1, including:

means (24) for directing the gas serially through and generally exteriorly about the column (16).

3. The apparatus (10) of claim 1, wherein the sidewalls (**15*b*,15*c*) are generally cylindrical, and the spacer member (31,31′ or 31″) is generally cylindrical with a plurality of similar apertures extending (32,32′ or 32″**) radially therethrough.

4. The apparatus (10) of claim 3, wherein the spacer member (31,31′ or 31″) has means (42) for interlockingly coupling it to the tubs (**14*b*,14*c***).

5. The apparatus (10) of claim 4, wherein said means (42) includes a plurality of projections (44) and a plurality of hooks (46).

6. The apparatus (10) of claim 5, wherein said projections (44) are radially outwardly extending nubs located at one end (45) of said spacer member (31,31′ or 31″) and said hooks (46) extend longitudinally and divergingly outwardly from the other end (47) thereof.

7. The apparatus (10) of claim 1, including:

means (42) for interlockingly coupling the spacer member (31,31′ or 31″) to the tubs (**14*b*,14*c***).

8. The apparatus (10) of claim 6, wherein said means (42) includes a plurality of projections (44) and a plurality of recesses (49), the projections (44) being individually releasably received in the respective recesses (49).

9. The apparatus (10) of claim 1, wherein the spacer member (31) includes radially outwardly extending baffle means (36′ or 36″) deflecting the gas inwardly through the aperture (32′ or 32″).

10. A tubular spacer member (31) for placement between a pair of tubular tubs (**14*b*,14*c*) open at both ends, having sidewalls (15), the tubular spacer member (31**), comprising:

an endless wall (40) defining a plurality of lateral apertures (32,32′ or 32″) therethrough, the wall (40) being alignable in abutting relation between the sidewalls (15) of the pair of tubs (**14*b*,14*c*); and means (42) for interlockingly coupling the spacer member (31) to the tubs (14*b*,14*c***).

11. The tubular spacer member (31) of claim 10, wherein said spacer member (31) had first and second ends (45,47) and said means (42) includes a plurality of projections (44) at the first end (45) and a plurality of recesses (49) defined in the second end (47).

12. The tubular spacer member (31) of claim 11, wherein each of said recesses (49) is defined by a longitudinally and divergingly outwardly extending hook (46).

13. The tubular spacer member (31) of claim 10, including:

baffle means (36′ or 36″) for deflecting a gas inwardly through the apertures (32′ or 32″).

14. A method of treating a plurality of parts (12) with a gas, comprising:

placing the parts (12) on an open frame work (20) within a pair of tubular tubs (**14*b*,14*c*) open at both ends and having generally flow impervious sidewalls (15**);

forming a column (16) by placing a tubular spacer member (31) in abutting relation between the tubs (**14*b* and 14*c***);

directing the gas in a first flow path longitudinally through the column (16); and controllably directing the gas inwardly into the column (16) through a plurality of lateral apertures (32,32′ or 32″) in the tubular spacer member (31).

15. The method of claim 14, wherein the gas is a carburizing gas.

16. The method of claim 14 including interlockingly coupling the tubular spacer member (31) to the tubs (**14*b*,14*c***).

* * * * *